United States Patent [19]

Pai

[11] 4,364,703

[45] Dec. 21, 1982

[54] ROTARY PARKING STRUCTURE FOR PASSENGER CARS

[76] Inventor: Yang-Kuang Pai, 2F No. 27, Lane 305, Wo-Lung St., Taipei, Taiwan

[21] Appl. No.: 130,447

[22] Filed: Mar. 14, 1980

[51] Int. Cl.[3] ..... E04H 6/16

[52] U.S. Cl. ..... 414/250

[58] Field of Search ..... 414/249, 250, 263

[56] References Cited

U.S. PATENT DOCUMENTS

| | | | |
|---|---|---|---|
| 1,867,675 | 7/1932 | McHenry et al. | 414/250 |
| 2,297,199 | 9/1942 | Buddecke | 414/250 |
| 2,663,437 | 12/1953 | Caiola | 414/250 |
| 2,689,658 | 9/1954 | Youell | 414/250 |
| 2,706,054 | 4/1955 | Morrison | 414/250 |
| 3,077,994 | 2/1963 | Foster | 414/250 |

*Primary Examiner*—James L. Rowland

*Attorney, Agent, or Firm*—Holman & Stern

[57] ABSTRACT

This invention relates to a beehive type mechanical three dimensional rotary parking structure for passenger cars comprising a circular casing, a plurality of parking compartments rockably deployed inside the circular casing, an axle fixed in the center of the circular casing, a driving means for rotating the casing, a set of rotary guide rails for the casing to rotate freely without resistance, and a support means with bearing type rollers and supporting rail. Considering the proportion of the area of land required to the capacity of the parking structure, this new type structure can accommodate more cars than ordinary ones. The larger is its capacity, the more land space can be saved and the easier is its administration. Therefore, this invention helps in solving the parking problem of a modern city.

3 Claims, 4 Drawing Figures

ROTARY PARKING STRUCTURE FOR PASSENGER CARS

OBJECTS AND SUMMARY OF THE INVENTION

This invention relates to a beehive type mechanical three dimensional rotary parking structure. In a modern city, especially a flourishing metropolitan with rapid growth of economy, its population as well as the number of vehicles for transportation are increasing correspondingly at a high rate. Skyscrapers and huge buildings are constructed close to one another resulting in a shortage of land space usable for the construction of conventional parking lots. This invention is to change the concept and building method of parking lots by adopting in its structure mechanical engineering, electrical engineering and computer science principles in coordination with civil engineering principles, so that a minimum amount of land (plane space) may be used for the design and construction of a beehive type three dimensional rotary carpark to solve the parking problem of a modern metropolitan area.

In the overall design of the above-mentioned parking structure, the inventor has studied and researched into the following main problems:

(a) Concept of the Present Design

Bearing in mind the difficulties in finding open spaces for the construction of necessary carparks in a flourishing modern city where population and number of vehicles are growing rapidly and roadside parking not only causes obstruction to traffic flow but also spoils the appearance and neatness of the city, the inventor managed to utilize a minimum land space for building a vertical three dimensional carpark by extending the required parking spaces both above and below ground level so as to save land space. Only a small area of land is needed for vehicles to come in and go out. For this reason, the design of this parking structure is round in shape with its largest diameter as the dividing line between its underground portion and above ground portion so that more cars may come in or go out at the same time thus reducing the time of parking or driving away. This carpark must be driven mechanically and each of its parking compartments will be sequentially on the same level with the ground for the cars to come in or go out. According to a preferred embodiment of this invention, this parking structure (the circular casing) is half underground and half above ground and the parking compartment on the same level with the ground will provide the passage way for cars.

(b) Weight Load

As the volume of the parking structure and the load it carries are rather large, there will be torsional inertia while rotating and any braking means would tend to wear out rapidly. The inventor has studied this problem and designed an axle which can bear the pressure without torsion, i.e. an hollow axle composed of a plurality of I-shape steel beam to increase its elasticity. Both ends of the axle are mounted on the bearing means on the base of reinforced concrete. Under the guide rail around the underground portion of the structure a plurality of bearing type rollers are provided, supporting and carrying the structure to rotate freely. A bearing rail is provided under the above mentioned bearing type rollers to support the bearing rollers when rolling around, and a bearing block is provided under the bearing rail to support the pressure on the bearing rail.

(c) Parking Compartment

A plurality of horizontally and vertically disposed U shape steel beams are used for forming rectangular spaces of desired size in the circular casing as parking compartments. This type of steel beam structure forms the main body for carrying the cars.

(d) Balance of Gravity of the Cars Inside the Parking Structure

This rotary structure is rotated mechanically, rendering sequentially each of the parking compartments on the same level as the ground for the cars to come in or go out. Since this parking structure is being rotated for 360°, the cars entering and parking in the parking compartments must be capable of maintaining balance of the centre of gravity; otherwise they will turn upside down when the structure is rotating and their function and safety will be lost. For this purpose, the inventor designs a circular beehive type parking compartment with self adjusting means for balancing its centre of gravity. The adjusting means consists of circular rails, with cylinder and bearing rollers provided therebetween. The circular rails are fixed on the rectangular frame of steel beams forming the parking compartment in such a way that the cylinder can move freely by means of the rolling action of the bearing rollers. Due to balanced weight and the parking on the supporting plate inside the cylinder, the centre of gravity of the car is positioned under the centre of the cylinder. Therefore, it can maintain its balance by self adjusting its centre of gravity no matter to what degree the structure rotates.

(e) Driving Force and its Transmission

To eliminate damage to the mechanism of the parking structure by torsional inertia, to facilitate its operation and to synchronize its turning speed, replaceable racks are provided on the edge of each end of the circular casing of the structure. The casing is driven by a motor through reduction means and worm or pinion gears meshing with the rack rendering the whole structure to rotate. In order to control the speed of rotation, and to stop and start for parking, a computerized electric control means is designed to manipulate the structure to meet actual requirements.

DESCRIPTION OF THE DRAWINGS

According to the above basic concept, the inventor has designed a rotary parking structure as shown in the attached drawings, in which.

DETAILED DESCRIPTION OF THE INVENTION

Figure 4:
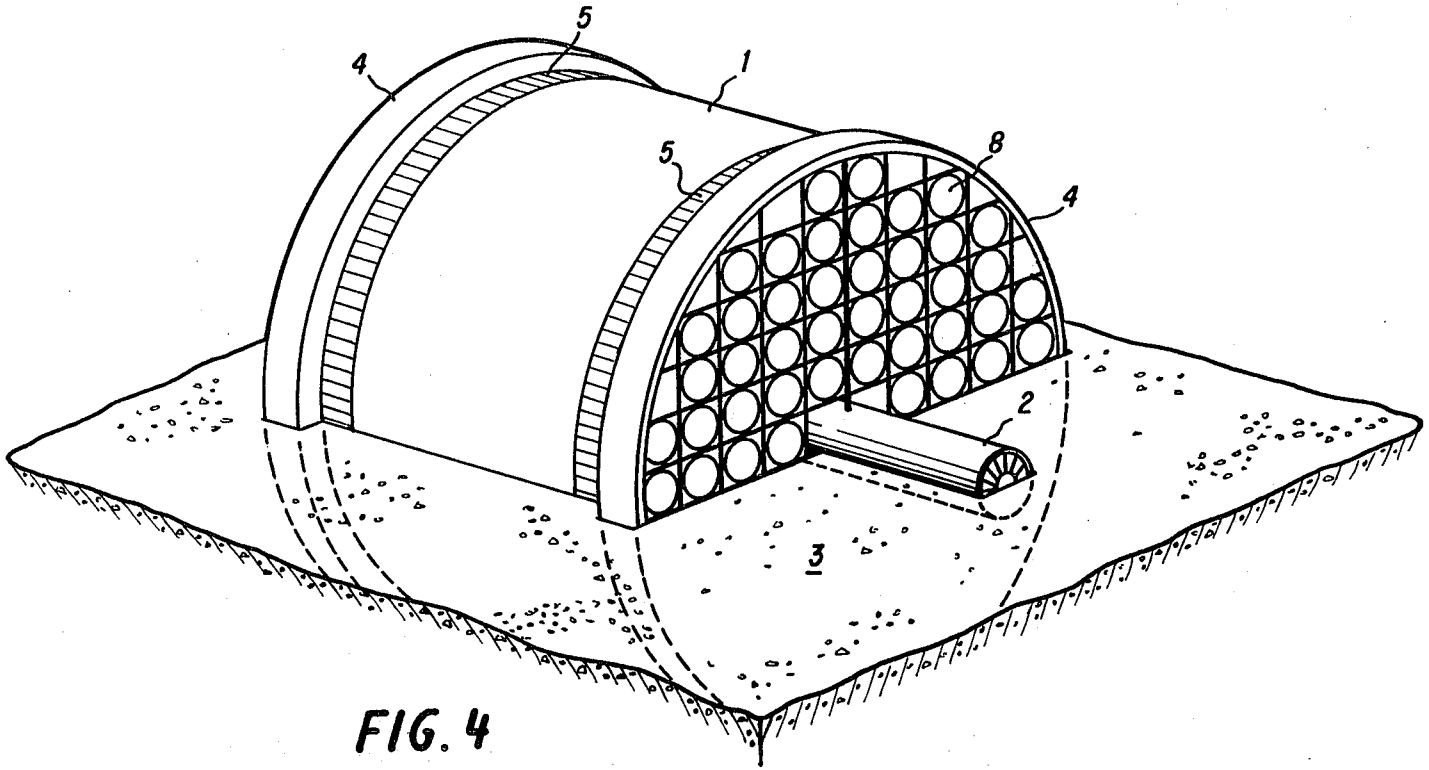

FIG. 4 is a perspective view of an embodiment showing only that part of the invention extending above ground level and illustrating an extended axle.

Figure 1:
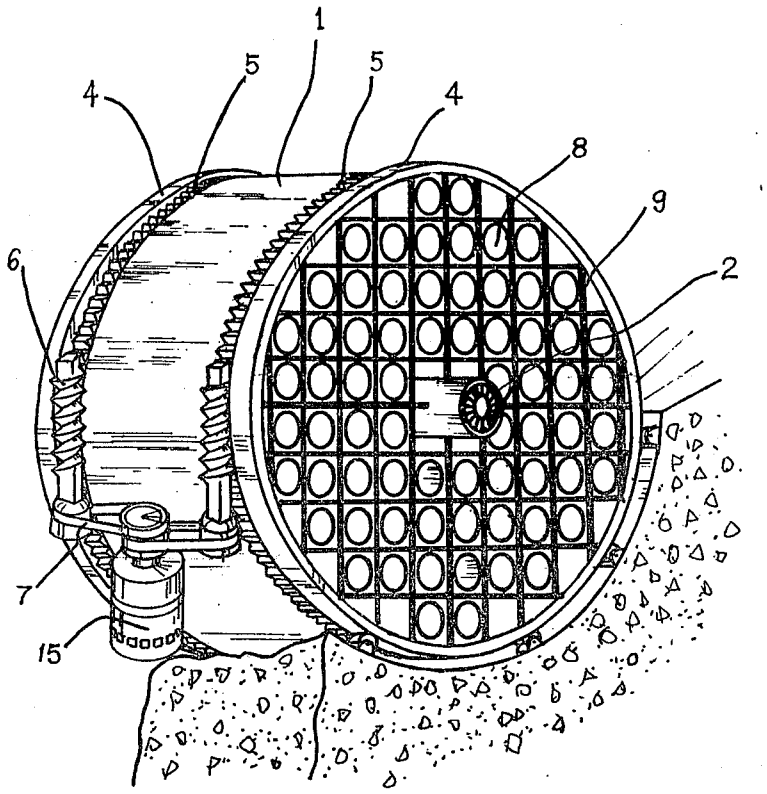
FIG. 1 is a schematic representation of the rotary parking structure of this invention.
Figure 3:
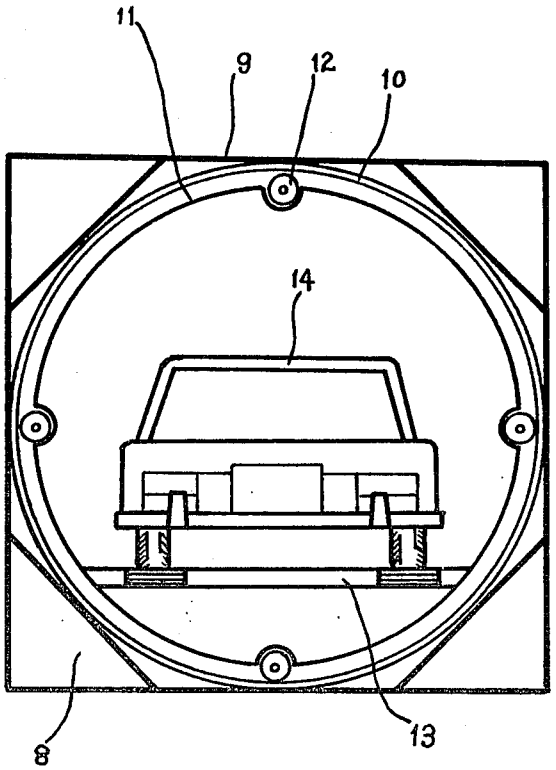
FIG. 3 is a front elevation showing the construction of a parking compartment unit and its parking condition.
Figure 2:
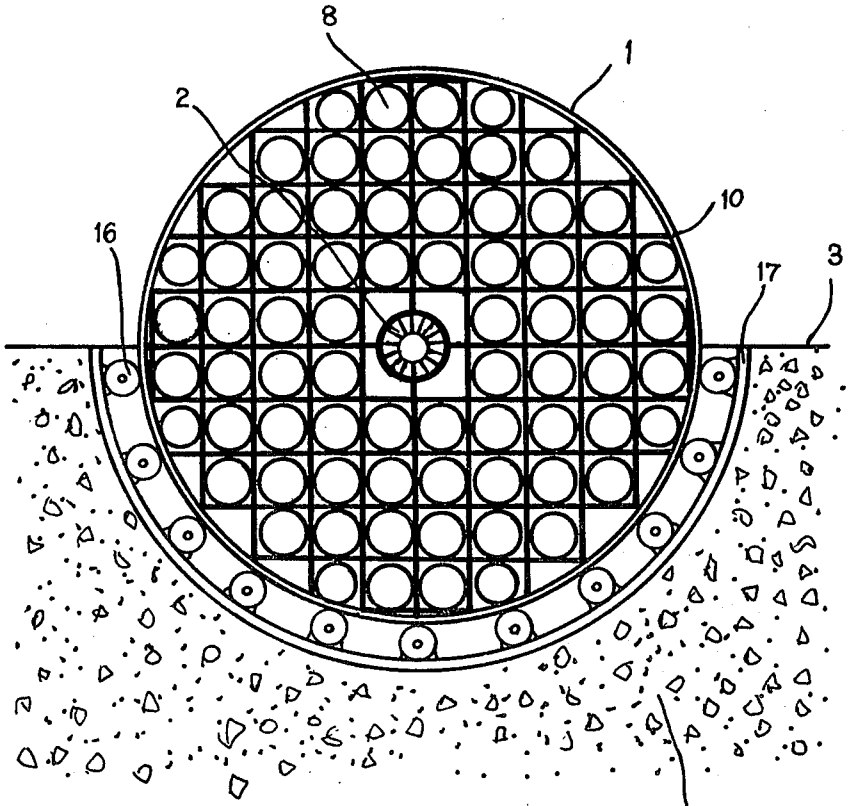
FIG. 2 is a front elevation showing the distribution conditions of the casing, the parking compartments and the load bearing structure.

In FIG. 2, circular casing 1 is supported on the reinforced concrete bases 3 by means of bearings not shown and is freely rotatable on the axle 2. Circular guide rails 4 (FIG. 1) are provided on the periphery of the circular casing 1, one each on the edge of two ends. The inner sides of the guide rails on both edges are provided with racks 5 which mesh with pinion or worm gears 6 connected to a driving motor 15 through reduction means 7. For the convenience of manufacturing, replacement and maintenance, the racks 5 are preferably designed into replaceable single-tooth type. A plurality of rectangular spaces 8 are formed by dividing vertically and horizontally the inside of casing 1 with U shape steel beams 9 according to the size required for car parking. A circular rail 10 is fixed at each of the front and the rear sides of the rectangular space 8. A cylinder 11 with both ends open is provided in the space defined by the circular rails 10 through rollers 12 and like, allowing the cylinder 11 to move along the circular rails 10. The structure of cylinder 11 is more clearly shown in FIG. 3. A supporting plate 13 is provided at the lower part of cylinder 11 for carrying a car 14, thus forming a parking compartment. In design, it must be ensured that when casing 1 rotates to any degree, the car 14 in the parking compartment 11 constantly maintains its original upright position. For this purpose, the horizontal centre line of the compartment must be set in a position higher than the centre of gravity of the car 10.

As described above, the compartment 11 can move freely along the circular rails 10, and again the centre of gravity of the car 10 is in the lower position in the compartment, therefore turning the car 10 upside down will be avoided.

The starting and stopping operations of the driving motor 15 which causes casing 1 to rotate is controlled by an electric control means not shown in the drawings.

Apart from the above mentioned axle 2, support means comprising bearing type rollers 16, support rail 17 and a base block 18 are additionally provided along the circular guide rails 10 of circular casing 1 in the underground portion for carrying the enormous weight of the parking structure and ensuring its safe and steady rotation.

Since the parking structure of this invention comprises the above mentioned circular casing, the parking compartments with self-adjusting balance of centre of gravity and its driving and bearing means, when the circular casing 1 rotates to a certain predetermined angle and stops, the surface of supporting plate 13 disposed in the parking compartment will be on the same level as the ground level and cars may freely enter or leave the parking compartment in both directions. The number of parking compartments in the above mentioned circular casing 1 may be designed at will according to the need, and the ground level for cars to move in and out may be of two stories according to the need, in order to increase the opportunities for car to enter and leave and reduce the time for parking or taking the car.

Concerning the plane space of land used for parking, the beehive type parking structure of this invention requires only an area for cars to enter and leave and its depth is only one car length; but it can accommodate more cars and is incomparable to the existing car parks in the world, because it is much more economical and practical. Fragments of land may be utilized for building the urgently needed parking structure in a flourishing city to solve the parking problems of a metropolitan area.

What is claimed is:

1. A rotary vehicle parking structure, comprising:

a storage structure comprising an axle, a lattice structure secured to said axle and forming a plurality of parking compartments and a circular casing surrounding and attached to said lattice structure, said parking compartments each including a plurality of circular rails attached to said lattice structure, a rotatable cylindrical tube within said rails, said tube open at both ends and having a parking platform mounted therein, and a plurality of rollers disposed between said rails and said tube;

support means comprising a central support means including said axle, and an external support means comprising a base having a semicircular cavity, circular guide rails attached to the peripheral edges of said circular casing and a plurality of bearing rollers disposed between said cavity and said circular guide rails;

means for rotating said storage structure comprising a power means connected to at least one pinion gear and at least one circular rack secured to the outer surface of said circular casing and engaging said at least one pinion gear.

2. The rotary vehicle parking structure according to claim 1, wherein said axle is hollow.

3. The rotary vehicle parking structure according to claim 2, wherein said hollow axle comprises an inner cylindrical tube, a concentric outer tube and a plurality of radially disposed I-shaped beams securing said inner tube to said outer tube.

* * * * *